United States Patent [19]

Schaefer et al.

[11] Patent Number: 4,955,999

[45] Date of Patent: Sep. 11, 1990

[54] STATIONARY STRAND DEFLECTOR FOR CONTINUOUS STRAND MANUFACTURE

[75] Inventors: William L. Schaefer, Butler; Walter J. Reese, North Huntingdon, both of Pa.

[73] Assignee: PPG Industries, Inc., Pittsburgh, Pa.

[21] Appl. No.: 418,095

[22] Filed: Oct. 6, 1989

[51] Int. Cl.[5] ..... C03B 37/02

[52] U.S. Cl. ..... 65/4.4; 65/9; 156/62.4

[58] Field of Search ..... 65/4.4, 9; 156/62.4, 156/62.6

[56] References Cited

U.S. PATENT DOCUMENTS

| | | | |
|---|---|---|---|
| 2,927,621 | 3/1960 | Slayter et al. | 65/9 |
| 3,787,194 | 1/1974 | Rayle et al. | 65/9 |
| 3,883,333 | 5/1975 | Ackley | 65/2 |
| 3,981,047 | 9/1976 | Contractor et al. | 65/9 X |
| 4,340,406 | 7/1982 | Neubauer et al. | 65/9 |
| 4,615,717 | 10/1986 | Neubauer et al. | 65/4.4 |

*Primary Examiner*—Robert L. Lindsay, Jr.

*Attorney, Agent, or Firm*—John E. Curley; Andrew C. Siminerio

[57] ABSTRACT

A strand deflector used in the manufacture of continuous strands is shown and described. The deflector comprises a rigid surface which stretches across the width of the mat making machine and which is interposed between the strand feeders located above it and the mat making surface so that the strands fed toward the surface must deflect from the deflector surface before they are collected on the mat making surface. The deflector surface is adjustable in the vertical direction and the angle of deflection with respect to the flow of strand from the feeder may also be changed to any desired value.

6 Claims, 2 Drawing Sheets

STATIONARY STRAND DEFLECTOR FOR CONTINUOUS STRAND MANUFACTURE

The present invention relates to the manufacture of continuous strand mats having improved mat density uniformity. More particularly, the present invention relates to the manufacture of continuous strand glass fiber mats of improved mat density uniformity. Still more particularly, the present invention relates to the improved laydown of glass fibers in the formation of continuous strand mats from glass fibers fed directly from a glass fiber forming bushing or from fiber glass strands contained on prepared forming packages or rovings.

BACKGROUND OF THE INVENTION

Continuous strand mats have been manufactured in the art using a variety of manufacturing methods. In the manufacture of continuous glass strand mats, for example, one process that has been used with considerable success is the process described and claimed in U.S. Pat. No. 4,615,717. In this patent the mats produced are needled to consolidate the strands by mechanical entanglement to thereby give the mat integrity and permit it to be handled. In the process described in this patent, the strands that make up the mat are projected in a downward direction onto the surface of a moving conveyor. In their travel to that surface they are deflected from their natural direction as they issue from the feeder by a plate-like deflection surface shown in FIG. 2 of the patent that is placed so that it interrupts the strands as they are fed downward and bounces them off of that surface onto the conveyor. This has the effect of causing the strands to form an elliptical or sometimes circular pattern as they descend from the deflector surface to the conveyor surface. The feeders themselves are constantly being traversed across and above the conveyor surface and the deflector surface used to interrupt strand flow is attached to the reciprocating feeders. The strands may be formed at fiber forming bushings and fed directly therefrom as shown in U.S. Pat. No. 3,883,333. The strands may also be fed forming packages which are stacked in creels and from which the already formed strands are passed to the reciprocating feeders. Use of either form is well known in the art and is described in U.S. Pat. No. 4,340,406, which also describes, in general, the reciprocating feeders employed in the art to produce continuous strand mats, and glass fiber mats in particular.

While the above described procedure of strand handling has been found to be beneficial in producing continuous glass strands, the market place in which the mats produced by this process continues to require improvement in the quality of the laminates made using these mats as reinforcements. This demand for higher quality by the end user laminators and their customers translate into more stringent requirements of the resin suppliers and, of course, for the suppliers of the reinforcing mats. One of the requirements that is being pursued vigorously is that of mat density uniformity from side to side and along the length of the mat. Improvements in this property are being requested and must be met if the quality of the finished laminates is to reach the levels required today in the market place. The applicant has by virtue of the instant invention developed an improvement in the aforementioned process that has improved significantly the uniformity of continuous strand mat made by that process.

SUMMARY OF THE INVENTION

In accordance with (he instant invention, an improved method and apparatus has been provided which, during the production of continuous strand mats, contributes significantly to the formation of mats having improved uniformity. Thus the invention involves a novel deflection system which is interposed between the strands that are being fed to a moving conveyor surface to form a mat thereon. The deflection surface is angled downward toward the moving conveyor surface but positioned above it and is located, with respect to the strand feeding device, so that all strands fed to the conveyor surface from that device will strike the surface of the deflector. The deflector characteristically has an elongated, rigid surface constructed of polished metal, stainless steel being preferred, and it covers the width of the conveyor surface on which strand is to be deposited. The deflector is also preferably mounted on supports independent of the mat-making equipment so that no machine vibrations effect the rigidity of the surface. The deflection surface is further constructed so that it can be adjusted in the vertical direction to change the distance between the conveyor and that surface. Finally, the deflector is provided with means to change the angle of the deflector surface with respect to the strands that are fed to it.

In accordance with another aspect of the invention, a method of forming a continuous strand mat is provided in which strands forming the mat are fed continuously onto the surface of a moving conveyor from one or more feeders located above the conveyor surface. The feeders traverse the width of the conveyor as they feed strands to the conveyor surface. In the feeding of the strands to the conveyor surface, they are directed onto the surface of a deflector which provides a rigid, uniform surface across the width of the conveyor, which surface is angled toward the conveyor surface uniformly across the conveyor surface as well as at the same distance therefrom. In one embodiment of the invention, strands which have been formed into packages or rovings are used as the feed. In another embodiment of the invention, it is contemplated that strands which are being gathered in a fiber forming operation are used as the feed to the mat making process.

BRIEF DESCRIPTION OF THE DRAWINGS

The invention will now be described with reference to the accompanying drawings in which.

DETAILED DESCRIPTION OF THE INVENTION

Figure 2:
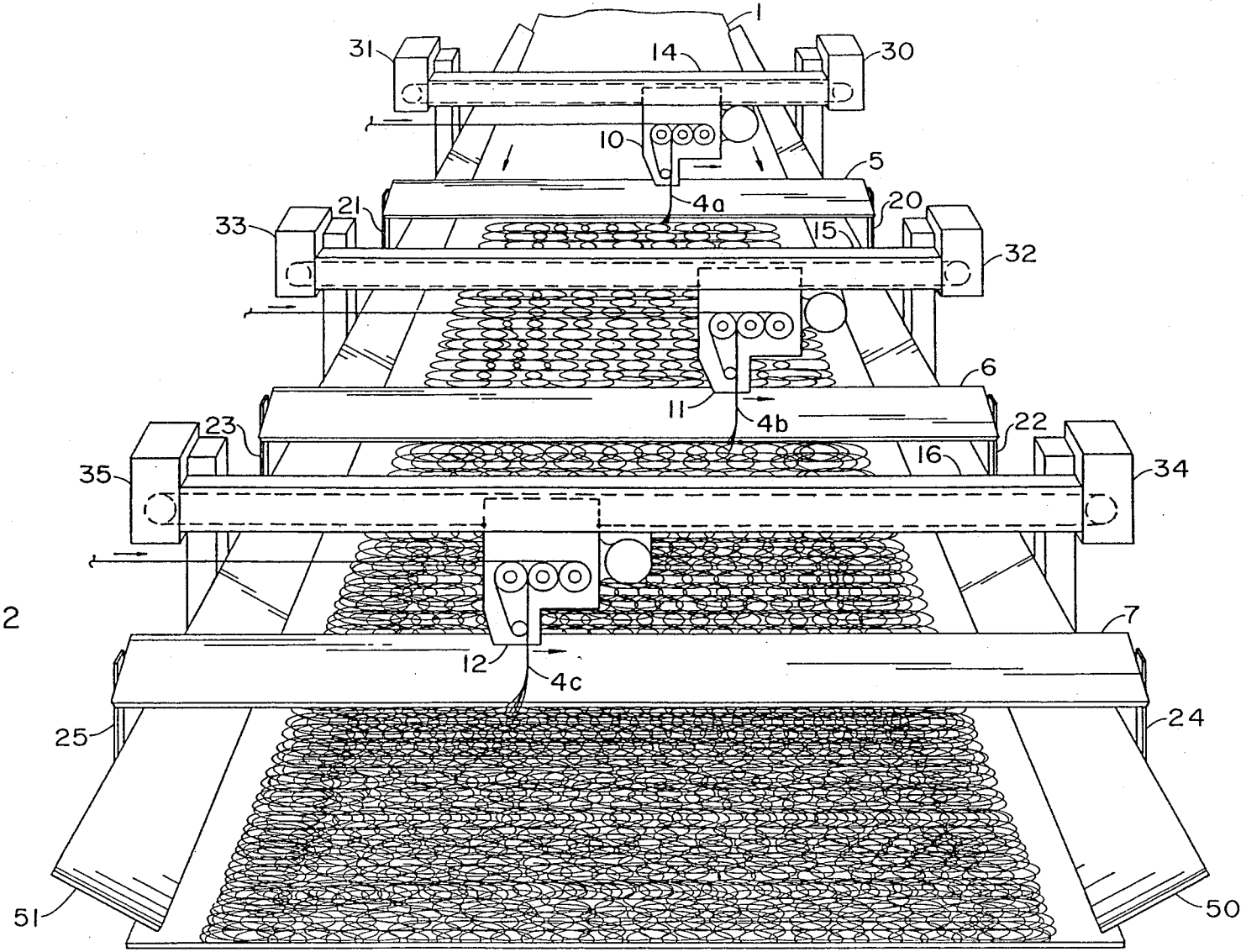
FIG. 2 is a perspective view of a mat making line showing the feeders, deflectors and conveyor of the instant invention and their relationships to each other.

Turning to the drawings, and in particular to FIG. 2, there is shown a conveyor 1 which in the FIG. 2 is moving from the back forward in the direction of the arrow. As the conveyor 2 moves forward, a plurality of strands 4a, 4b and 4c are deposited on the surface of the conveyor 1 after they are deflected from the deflectors 5, 6, and 7, respectively. As shown, the deflectors 5, 6 and 7 are flat plate structures which have the deflection surfaces angled downwardly in the direction of the conveyor 1 and the surfaces extend across the width of the conveyor 1. Strands 4a, 4b and 4c are projected from feeders 10, 11, and 12, respectively. The feeders 10, 11, and 12, as shown, reciprocate on the rails 14, 15, and 16, respectively, while they discharge strands toward the conveyor 1. The feeding of the strands from each of the feeders 10, 11 and 12 takes place continuously as they reciprocate from one side of the conveyor to the other. Thus, for example feeder 10 travels from the right side of the rail 14 to the left side of that rail and is then reversed and moves from the left side to the right side. All the time that the feeder 10 is travelling from side to side, it is discharging strand onto the deflector 5 and from there to the conveyor 1. Feeders 11 and 12 operate in the same way, typically at the same time.

The deflectors 5, 6, and 7 are mounted in the positions shown by the brackets 20 and 21, 22 and 23, and 24 and 25, respectively. The rails 14, 15, and 16, in similar fashion, are mounted on the brackets 30 and 31, 32 and 33, and 34 and 35, respectively. While not shown, the brackets 20, 21, 22, 23, 24, and 25 are provided with an appropriate slot and bolt arrangement so that the deflector between each set of brackets can be raised or lowered vertically with respect to surfaces at the conveyor 1 and so that the deflector surface between each set of brackets can be tilted to vary the angle at which the strands will strike the surface of a given deflector.

In the operation of the system shown in FIG. 2, the conveyor 1 is typically actuated into movement by starting the motor that drives it. As the conveyor 2 begins to move, the feeders 10, 11 and 12 are activated and begin to traverse across the conveyor on the rails 14, 15 and 16. Strands 4a, 4b and 4c are fed from each of the feeders 10, 11, and 12, respectively, on a continuous basis and are projected downwardly onto the surfaces of deflectors 5, 6, and 7, respectively. The deflectors 5, 6 and 7 interrupt the flow of the strands coming from the feeders 10, 11 and 12 and as the strands strike the surfaces of the deflectors 5, 6 and 7, their velocity is reduced and the strands tend to assume a circular or elliptical form as they fall to the surface of the conveyor 1.

It has been found that by preparing continuous strand mats using the deflectors of the instant invention that the uniformity of the mats produced in terms of density across the width of the mat can be improved significantly. The deflectors 5, 6 and 7 shown are generally constructed of metal such as steel, stainless being preferred, but can be made of rigid plastic, polished wood and the like. It is important that the surface of the deflectors used on the lines for the manufacture be rigid in the sense that they do not bend or otherwise deform in use as the strands strike them. It is also important that the deflectors encounter no substantial movement during use from vibrations or otherwise. For this reason, it is preferred to have them mounted on brackets 20, 21, 22, 23, 24 and 25 outside of the guide rails 50 and 51, which are used to catch any excess strands from the feeders and direct them onto the conveyor 1. By mounting the deflectors 5, 6 and 7 in this manner, vibrations of the chain conveyor are not translated to the deflectors. Once the angle of the deflector and its distance from the conveyor surface have been determined and the deflectors have been set to those values to provide an acute angle between the strands striking their surfaces located closest to the feeder, they are locked in place and maintained in those positions during the mat manufacturing process.

Figure 1:
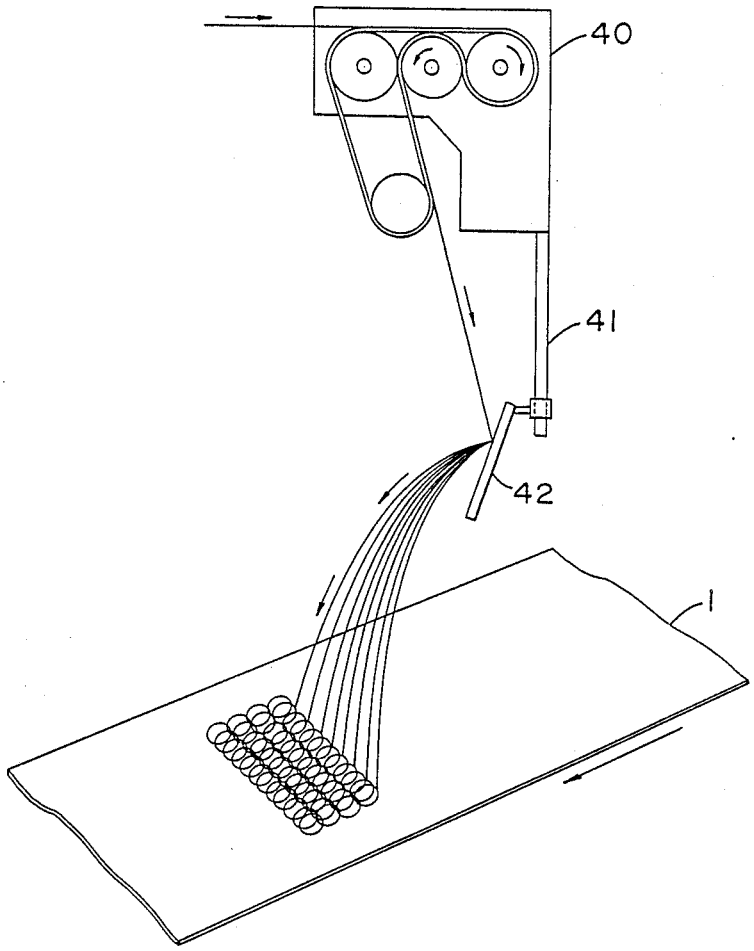
FIG. 1 (PRIOR ART)
FIG. 1 is a side elevation partially in perspective showing a typical prior art feeder and associated deflector used in depositing strand on a conveyor to form mat.

The mats produced by the prior art process, over which the present system is designed as an improvement, have used a feed system such as shown in FIG. 1. The mats produced by that system frequently have sh variations in density from side to side. These variations have been introduced into the mats because of the arrangement of the feeders and their associated deflectors. Thus, in the drawing the feeder 40 shown, which is identical to the feeders 10, 11, 12 of FIG. 1, has a bracket 41 attached to it which has affixed to it a deflector 42. The deflector 42 is placed so that it will interrupt the downward flow of the strands coming from the feeder 40. When the feeder 40 and its associated deflector 42 conforming to this configuration are used on the mat making lines such as the conveyor system shown in FIG. 2, the density of the mat from side to side is not as uniform as that produced by the instant invention. This is believed to be caused by the fact that as the feeders of FIG. 1 traverse across the width of the conveyor on the rails shown in FIG. 2 they tend to move from side to side. Further and more importantly, the deflectors 42 are subjected to considerable vibration during the traversing of the feeder 40. The vibrations are even more exaggerated as the feeder 40 reverses at the end of its traverse in one direction to begin its traverse in the opposite direction.

By employing the deflectors of the instant which are rigid and provide a fixed, immovable surface across the width of the surface on which the mat is being produced and which has a uniform deflection across that width, substantial improvements in the uniformity of the mat density are realized. To illustrate the advantages of the invention, reference is made to the following example which describes the manufacture of a continuous glass strand mat made with the deflector system of the instant invention.

Example

A continuous strand fiber glass was made utilizing a mat making line similar to that shown in FIG. 2 herein. The line had 12 feeders in series and each feeder was fed with 6 ends of glass fiber strand. The glass fibers were "t" fibers and each end had 400 fibers. The feeders projected the strands downward toward the conveyor surface at a rate of 1250–1300 feet per minute and each of the feeders reciprocated across the width of the conveyor and back in 6 second cycles. The stationary deflectors used to interrupt the flow of strand were placed beneath each of the 12 feeders and above the surface of the conveyor. The deflection angle of the deflector surface (the acute angle formed by the strand striking the deflector surface closest to the feeder) was fixed for each of the deflectors at 45 degrees to insure that the strands were deflected from their surfaces in the same way at each feeder point. The conveyor was operated at a linear speed of 12 feet per minute during the run and the mat produced was targeted to have an average mat density of 3 ounces per square foot. The variation in the mat density from side to side (COV) was measured and was found to be 4 percent. This COV was considered to be a significant improvement over the COV of 6 percent, which is obtained when the same density mat is prepared using the feeder-deflector arrangement shown in FIG. 1 on the same mat line using the same strands of glass, conveyor speeds and feeder rates.

While the invention has been described in the example with reference to a feed of glass fibers, that is for illustrative purposes only since the method and apparatus herein described can be used to prepare continuous mats from synthetic fibers such as organic polymeric fibers (polypropylene, polyesters, nylons and the like being typical non-exclusive examples), natural fibers (cotton, wool and linen being typical non-exclusive examples) and inorganic fibers (graphite and silica being typical non-exclusive examples). Blends and mixtures of any of these fibers with each other and of either glass fibers are within the contemplation of the inventor.

Therefore, while the invention has been described further with reference to certain illustrative embodiments and specific examples, it is not intended to be limited thereby except insofar as appears in the accompanying claims.

What is claimed is:

1. In the process of manufacturing continuous strand mat wherein strands of continuous fibers are deposited onto the surface of a moving conveyor and across the width thereof by feeding the strands downward from a plurality of feeders toward the surface of the conveyor and where the strands are interrupted in their downward passage before reaching the conveyor, the improvement comprising passing the strands in their downward path onto the surface of a deflector which is mounted independent of the feeder and which has an adjustable surface, said independently mounted deflector being rigidly affixed across the width of the conveyor surface on which the strands are to be deposited and having its surface angled toward the surface of the conveyor to thereby direct the strands downwardly therefrom onto the conveyor surface.

2. The method of claim 1 wherein the strands are glass strands and the fibers are glass fibers.

3. The method of claim 1 wherein the acute angle formed by the strands striking the surface of the deflector closest to the feeder is between 20 and 70 degrees.

4. The method of claim 2 wherein the acute angle formed by the strands striking the surface of the deflector closest to the feeder is between 20 and 70 degrees.

5. In a process for forming a continuous glass fiber strand mat on a moving conveyor surface wherein glass strands are deposited across the width of a moving conveyor surface by feeding said glass fiber strands downwardly toward the surface of the conveyor from a plurality of feeders that are reciprocating back and fourth above the conveyor, interrupting the glass fiber strands in their travel from the feeds and before they contact the conveyor surface, the improvement comprising passing the strands to the surface of a deflector that is provided across the width of the conveyor and which is not affixed to the feeders, said deflector being rigid in its mounting and not attached to any moving part of the mat making operation, and angling the surface of the deflector toward the conveyor surface so that the strands of glass impinging on the surface thereof for an acute angle with the surface of the deflector closes to the feeder.

6. The method of claim 5 wherein the said acute angle is between 20 and 70 degrees.

* * * * *

UNITED STATES PATENT AND TRADEMARK OFFICE

CERTIFICATE OF CORRECTION

PATENT NO. : 4,955,999

DATED : September 11, 1990

INVENTOR(S) : Schaefer, et al.

It is certified that error appears in the above-indentified patent and that said Letters Patent is hereby corrected as shown below:

On the Title Page of the patent, please correct the U.S. Serial Number as follows: "418,095" should be --418,005--.

Signed and Sealed this

Twenty-third Day of August, 1994

Bruce Lehman

*Attest:*

BRUCE LEHMAN

*Attesting Officer*

*Commissioner of Patents and Trademarks*